US006168276B1

(12) United States Patent
Weid

(10) Patent No.: US 6,168,276 B1
(45) Date of Patent: Jan. 2, 2001

(54) ROAD SAFETY REFLECTOR

(76) Inventor: Karl Weid, 1276 Robinwood Dr., Elgin, IL (US) 60123

( * ) Notice: Under 35 U.S.C. 154(b), the term of this patent shall be extended for 0 days.

(21) Appl. No.: 09/393,452

(22) Filed: Sep. 10, 1999

(51) Int. Cl.[7] ..... G02B 5/136

(52) U.S. Cl. ..... 359/547; 359/515; 359/531; 359/532; 359/551; 359/552; 359/900; 404/12

(58) Field of Search ..... 359/515–553, 359/900; 404/9–16; 116/63 R, 63 P, 63 C, 63 T

(56) References Cited

U.S. PATENT DOCUMENTS 4,237,191 * 12/1980 Horne ..... 359/551
4,717,281 * 1/1988 Shepherd et al. ..... 359/551
5,791,605 * 8/1998 Howie, II ..... 359/551

* cited by examiner

*Primary Examiner*—James Phan
(74) *Attorney, Agent, or Firm*—Matthew R. P. Perrone, Jr.

(57) ABSTRACT

A road safety reflector assembly has a pair of oppositely disposed finger cradles with a hollow, reinforceable housing, which has one or two reflectors mounted therein.

21 Claims, 2 Drawing Sheets

ROAD SAFETY REFLECTOR

This invention relates to a road safety reflector and more particularly to a road safety reflector, which may easily gripped, for proper positioning, prior to adhering the same to a road surface.

BACKGROUND OF THE INVENTION

Reflecting road markers augment the stripes in the road. The reflecting road markers can be colored to indicate the kind of stripes being used on the road. Typically, the stripes are white, yellow, dashed, continuous or combinations thereof. Such stripes can indicate lane divisions, and passing or no passing sections of the road.

With an appropriately colored reflector, the type of stripe or stripes can be emphasized. These reflecting devices are placed on and secured to the road. However, it is difficult to place them on the road in an appropriate position.

The road material is very hot. Yet the devices must still be secured thereto. It is necessary for the worker to handle each reflector device and place each one in the proper position at the proper time. However, it is extremely difficult to grip the devices.

The reflecting devices must also be durable. The attachment to the road requires durability. Enduring the traffic pounding requires durability. This durability requirement must be met while providing ease of attachment and positioning Due to the heat required for adhering the reflectors to the road, gloves must be worn during the application of the reflector to the road. Gloves, of course, interfere with a firm grip. Something must be done to compensate for the countervailing requirements of gloves and precise placement.

A larger size for the reflector cannot solve the problem of gripping. The reflectors cannot be larger than a certain size. All highway departments impose size limitations on such reflectors.

If gripping can be improved while at the same time maintaining the reflecting capabilities without destroying the aesthetic appearance of the reflector, great advantages can be obtained.

SUMMARY OF THE INVENTION

Among the many objectives of this invention is to provide a grippable road safety reflector assembly, which is easily positioned on a road.

Another objective of this invention is to provide a grippable road safety reflector assembly, which is easily positioned by a gloved hand.

Yet another objective of this invention is to provide a grippable road safety reflector assembly, which has a desired size.

Still another objective of this invention is to provide a grippable road safety reflector assembly, which is durable.

Additionally, an objective of this invention is to provide a flexible grippable road safety reflector assembly.

Also, an objective of this invention is to provide a flexible grippable road safety reflector assembly, which stays in position.

A further objective of this invention is to provide a grippable road safety reflector assembly having two reflective surfaces.

These and other objectives of the invention (which other objectives become clear by consideration of the specification, claims and drawings as a whole) are met by providing a road safety reflector assembly having a pair of oppositely disposed finger cradles with a hollow, reinforceable housing.

BRIEF DESCRIPTION OF DRAWINGS

Throughout the figures of the drawings where the same part appears in more than one figure the same number is applied thereto.

DESCRIPTION OF THE PREFERRED EMBODIMENTS

In the road safety reflector assembly of this invention, the reflector assembly has a shape similar to that of a truncated pyramid. This provides for four trapezoidal sides connecting two substantially rectangular sides. However, two opposing trapezoidal sides provide a first notch side oppositely disposed from a second notch side. First notch side combines with second notch side to provide opposing finger cradles for gripping purposes.

First notch side and second notch side are perpendicular to the reflector sides. These notch sides permit the gripping. Because the notch proceeds all the way down the housing and is hemi-cylindrical in nature, it is permitted to grab and efficiently place the device. In this fashion, the workers, even with their gloves, can place the reflectors and achieve the desired results.

Furthermore, the notch structure permits rain and ice to separate easily from the grippable road safety reflector assembly. There is no surface to trap the water or ice on the reflector assembly.

Figure 1:
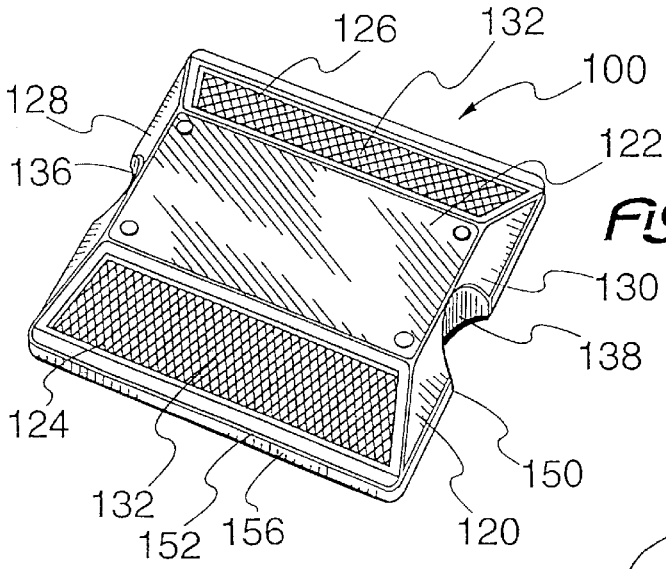
FIG. 1 depicts a top, perspective view of a grippable road safety reflector assembly 100 of this invention.
Figure 2:
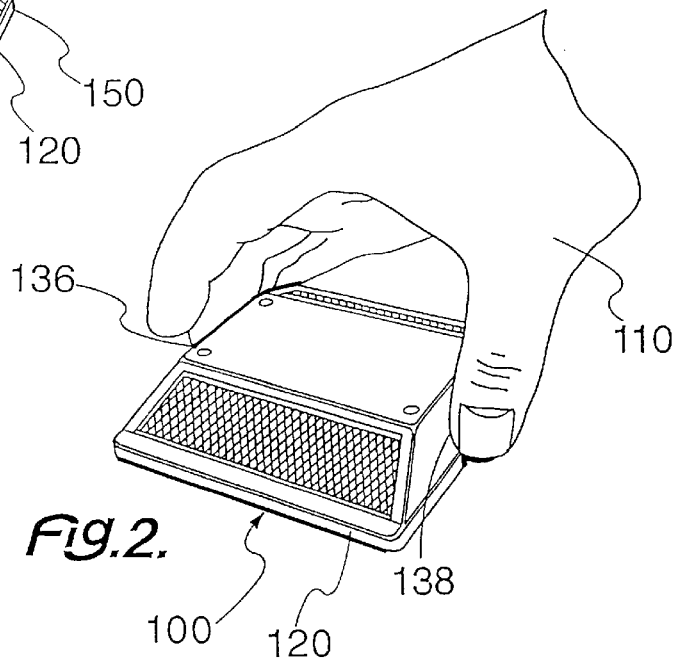
FIG. 2 depicts a top, perspective view of a grippable road safety reflector assembly 100 of this invention, held by a hand 110.

Referring now to FIG. 1 and FIG. 2, perspective view of a grippable road safety reflector assembly 100 of this invention is easily held by a hand 110. Housing 120 of grippable road safety reflector assembly 100 has a shape similar to that of a truncated pyramid.

This truncated structure provides for four trapezoidal sides connecting two substantially rectangular sides. Two opposing trapezoidal sides form first reflector side 124 and second reflector side 126. The remaining opposing trapezoidal sides provide a first notch side 128 oppositely disposed from a second notch side 130. First notch side 128 combines with second notch side 130 to provide for gripping fingers of hand 110.

First reflector side 124 and second reflector side 126 each have a reflector element 132 secured therein. Such securing may be accomplished by gluing or other suitable fashion.

First notch side 128 and second notch side 130 are perpendicular to the first reflector side 124 and second reflector side 126. First finger cradle 136 is positioned in first notch side 128. Second finger cradle 138 is positioned in second notch side 130.

First notch side 128 and second notch side 130 permit the gripping. Because first finger cradle 136 and second finger cradle 138 (that is the notches) are so positioned, proceed down the housing 120 and are hemi-cylindrical in nature, it is permitted to grab and efficiently place the grippable road safety reflector assembly 100. In this fashion, the workers, even with their gloves, can place the reflectors and achieve the desired results.

More specifically, first finger cradle 136 and second finger cradle 138 run from topside 122 of housing 120 to the hollow base 150 of housing 120. An optional lip 152 runs around the edge 156 of hollow base 150 in order to provide additional strength to housing 120.

Figure 3:
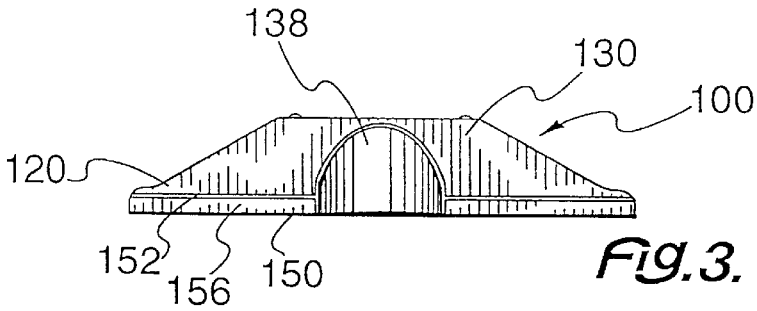
FIG. 3 depicts a side view of a grippable road safety reflector assembly 100 of this invention.
Figure 4:
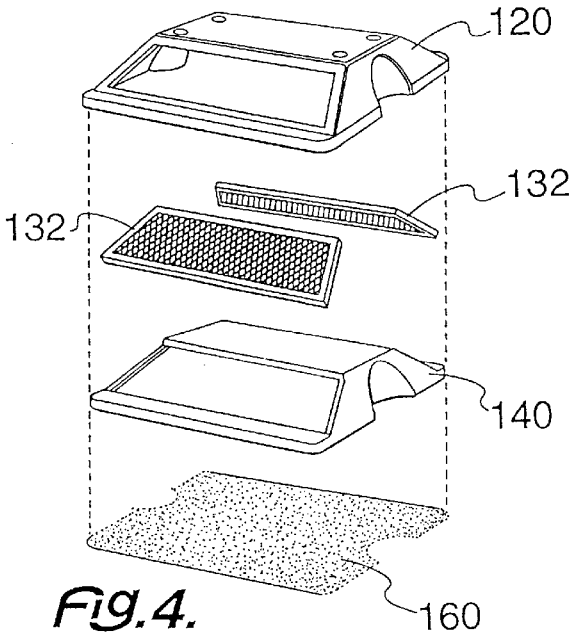
FIG. 4 depicts a end, plan view of a grippable road safety reflector assembly 100 of this invention.

FIG. 3 and FIG. 4 combine to show a preferred structure for the grippable road safety reflector assembly 100. The bonded sand layer 160 may fill the hollow housing 120 and provide both adherence to the road 112 and support for the grippable road safety reflector assembly 100.

Figure 5:
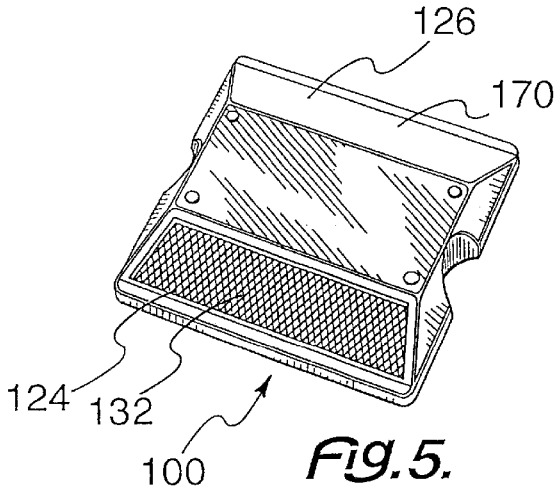
FIG. 5 depicts a top, perspective view of a grippable road safety reflector assembly 100 of this invention with only first reflector side 124.

With FIG. 5, first reflector side 124 has a reflector element 132, while second reflector side 126 has a non reflecting element 170, replacing reflector element 132, secured therein. Non reflecting element 170 may also be molded directly therein. This permits formation of a one-sided reflector element when desired. Such securing may be accomplished by gluing or other suitable fashion.

Figure 6:
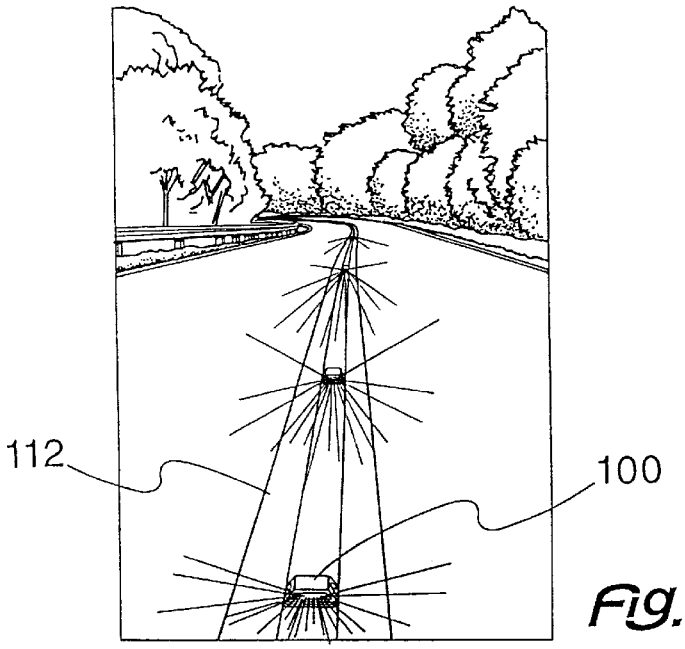
FIG. 6 depicts a plurality of a grippable road safety reflector assembly 100 of this invention in position on a road 112.

In this fashion the grippable road safety reflector assembly 100 may be efficiently secured to the road 112 as shown in FIG. 6.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A grippable road safety reflector assembly comprising;

(a) a housing having at least one reflecting means mounted therein;

(b) the housing having a first finger cradle and a second finger cradle;

(c) the first finger cradle being oppositely disposed from the second finger cradle; and (d) the first finger cradle and the second finger cradle including a freeflowing means in order to avoid trapping of fluid therein.

2. The grippable road safety reflector assembly of claim 1 further comprising;

(a) the housing having a hollow base; and (b) the hollow base having reinforcing means.

3. The grippable road safety reflector assembly of claim 2 further comprising;

(a) the housing having a shape of truncated pyramid; and (b) the hollow base having an edge therearound; and (c) the reinforcing means being a lip around the edge of the hollow base.

4. The grippable road safety reflector assembly of claim 3 further comprising;

(a) the truncated pyramid provides for a set of trapezoidal sides;

(b) the set of trapezoidal sides including a first trapezoidal side, a second trapezoidal side, a third trapezoidal side, and a fourth trapezoidal side;

(c) the first trapezoidal side being oppositely disposed from the third trapezoidal side; and (d) the second trapezoidal side being oppositely disposed from the fourth trapezoidal side.

5. The grippable road safety reflector assembly of claim 4 further comprising;

(a) the first trapezoidal side having the first finger cradle therein;

(b) the third trapezoidal side having the second finger cradle therein;

(c) at least one reflector being mounted in at least one position selected from the group consisting of the second trapezoidal side and the fourth trapezoidal side.

6. The grippable road safety reflector assembly of claim 5 further comprising;

(a) the set of trapezoidal sides connecting two substantially rectangular sides;

(b) the first finger cradle and the second finger cradle being substantially hemi-cylindrical in shape;

(c) the first trapezoidal side having a first trapezoidal height;

(d) the third trapezoidal side having a second trapezoidal height;

(e) the first finger cradle having a first cylindrical height;

(f) the second finger cradle having a second cylindrical height; and (g) the first trapezoidal height, the second trapezoidal height, the first cylindrical height and the second cylindrical height being substantially equal.

7. The grippable road safety reflector assembly of claim 6 further comprising;

(a) an adhesive filler being in the hollow housing to secure to a road; and (b) the adhesive filler supporting the hollow housing.

8. The grippable road safety reflector assembly of claim 6 further comprising;

(a) the at least one reflector being a first reflector mounted in the second trapezoidal side; and (b) the at least one reflector being a second reflector mounted in the fourth trapezoidal side.

9. A grippable road safety reflector assembly comprising;

(a) a housing having at least one reflecting means mounted therein;

(b) the housing having a first finger cradle and a second finger cradle;

(c) the first finger cradle being oppositely disposed from the second finger cradle;

(d) the first finger cradle and the second finger cradle including a freeflowing means in order to avoid trapping of fluid therein; and (e) the freeflowing means having the first finger cradle and the second finger cradle being open.

10. The grippable road safety reflector assembly of claim 9 further comprising;

(a) the housing having a hollow base; and (b) the hollow base having reinforcing means.

11. The grippable road safety reflector assembly of claim 10 further comprising;

(a) the housing having a shape of truncated pyramid; and (b) the hollow base having an edge therearound; and (c) the reinforcing means being a lip around the edge of the hollow base.

12. The grippable road safety reflector assembly of claim 11 further comprising;

(a) the truncated pyramid provides for a set of trapezoidal sides;

(b) the set of trapezoidal sides including a first trapezoidal side, a second trapezoidal side, a third trapezoidal side, and a fourth trapezoidal side;

(c) the first trapezoidal side being oppositely disposed from the third trapezoidal side; and (d) the second trapezoidal side being oppositely disposed from the fourth trapezoidal side.

13. The grippable road safety reflector assembly of claim 12 further comprising;

(a) the first trapezoidal side having the first finger cradle therein;

(b) the third trapezoidal side having the second finger cradle therein;

(c) at least one reflector being mounted in at least one position selected from the group consisting of the second trapezoidal side and the fourth trapezoidal side.

14. The grippable road safety reflector assembly of claim 13 further comprising;

(a) the set of trapezoidal sides connecting two substantially rectangular sides;

(b) the first finger cradle and the second finger cradle being substantially hemi-cylindrical in shape;

(c) the first trapezoidal side having a first trapezoidal height;

(d) the third trapezoidal side having a second trapezoidal height;

(e) the first finger cradle having a first cylindrical height;

(f) the second finger cradle having a second cylindrical height; and (g) the first trapezoidal height, the second trapezoidal height, the first cylindrical height and the second cylindrical height being substantially equal.

15. The grippable road safety reflector assembly of claim 14 further comprising;

(a) an adhesive filler being in the hollow housing to secure to a road; and (b) the adhesive filler supporting the hollow housing.

16. The grippable road safety reflector assembly of claim 15 further comprising;

(a) the at least one reflector being a first reflector mounted in the second trapezoidal side; and (b) the at least one reflector being a second reflector mounted in the fourth trapezoidal side.

17. A method of applying a grippable road safety reflector assembly to a road comprising;

(a) providing a hollow housing having at least one reflecting means mounted therein;

(b) providing the housing with a first finger cradle oppositely from a second finger cradle having a freeflowing means in order to avoid trapping of fluid therein;

(c) filling the hollow housing with an adhesive;

(d) gripping the first finger cradle and the second finger cradle; ancd (e) placing the grippable road safety reflector assembly in a desired position on a road.

18. The method of claim 17 further comprising;

(a) having a substantially hemi-cylindrical shape for the first finger cradle and the second finger cradle; and (b) having the substantially hemi-cylindrical shape extend an entire height of the housing in order to provide for effective gripping.

19. The method of claim 17 further comprising;

(a) having a substantially hemi-cylindrical shape an adhesive filler being in the hollow housing to secure to a road; and (b) supporting the hollow housing with the adhesive filler.

20. The method of claim 19 further comprising;

(a) having at least one reflector mounted in the housing; and (b) providing a reinforcing means for the grippable road safety reflector.

21. The method of claim 19 further comprising the at least one reflector mounted being two oppositely disposed reflectors.

* * * * *